US007986896B2

(12) United States Patent
Kim et al.

(10) Patent No.: US 7,986,896 B2
(45) Date of Patent: Jul. 26, 2011

(54) IMAGE FORMING APPARATUS TO CONTROL NOISE AND METHOD THEREOF

(75) Inventors: Se joong Kim, Seoul (KR); Jong-yang Choo, Yongin si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 100 days.

(21) Appl. No.: 12/426,350

(22) Filed: Apr. 20, 2009

(65) Prior Publication Data

US 2010/0080604 A1 Apr. 1, 2010

(30) Foreign Application Priority Data

Oct. 1, 2008 (KR) ..... 10-2008-0096723

(51) Int. Cl.
*G03G 15/00* (2006.01)

(52) U.S. Cl. ..... 399/88; 399/69; 399/70

(58) Field of Classification Search ..... 399/38, 399/67–70, 75, 88

See application file for complete search history.

(56) References Cited

U.S. PATENT DOCUMENTS

| | | | | |
|---|---|---|---|---|
| 7,116,923 | B2 * | 10/2006 | Kishi et al. | 399/69 |
| 7,639,963 | B2 * | 12/2009 | Matsuo | 399/88 |
| 2007/0189795 | A1 * | 8/2007 | Chae et al. | 399/69 |

* cited by examiner

*Primary Examiner* — Hoan Tran
(74) *Attorney, Agent, or Firm* — Stanzione & Kim, LLP

(57) ABSTRACT

Provided is an image forming apparatus and a method of controlling the same. When an external power is supplied to a heating resistance member of a fusing unit in the image forming apparatus that is in a standby mode, a power supply unit supplies an internal power to a different load (for example, an exposure unit, a developing unit, or a transfer unit) in one or more time sections so as to supply the internal power to the load at a continuously changing operating frequency.

25 Claims, 3 Drawing Sheets

IMAGE FORMING APPARATUS TO CONTROL NOISE AND METHOD THEREOF

CROSS-REFERENCE TO RELATED APPLICATIONS

This application claims priority under 35 U.S.C. §119(a) from Korean Patent Application No. 10-2008-0096723, filed on Oct. 1, 2008, in the Korean Intellectual Property Office, the disclosure of which is incorporated herein in its entirety by reference.

BACKGROUND

1. Field of the Invention

The present general inventive concept relates to an image forming apparatus to control noise, and more particularly, to a method of controlling noise generated by an image forming apparatus in a standby mode.

2. Description of the Related Art

Image forming apparatuses (for example, printers) include an exposure unit performing an exposure process with respect to a photosensitive drum according to printing data that is to be printed and forming an electrostatic latent image, a developing unit developing the electrostatic latent image using developer, a transfer unit transferring the developed image onto a printing medium, a fusing unit to fuse the transferred image to the printing medium, and a switch mode power supply (SMPS) converting alternating power supplied from outside of the image forming apparatus into direct power of a predetermined voltage to supply the power at a predetermined operating frequency. A typical image forming apparatus also includes a filter to filter noise in the image forming apparatus, and a controller controlling operations of the exposure unit, the developing unit, the transfer unit, the fusing unit, and the SMPS.

The operating frequency of the SMPS may vary depending on the power supplying load of the SMPS. However, since the load of the SMPS for applying the power is quite high when the image forming apparatus is in a standby mode (for example, the SMPS only supplies the power to the controller when the image forming apparatus is in the standby mode), the SMPS operates at a certain operating frequency when the image forming apparatus is in the standby mode. Subsequently, noise is generated at the certain operating frequency and a multiplying frequency of the operating frequency. Accordingly, it is difficult to control the noise generated in the standby mode in the conventional image forming apparatus.

Additionally, the fusing unit is a fusing roller including a heating resistance member that generates heat in response to the power supplied from outside of the image forming apparatus. In order for the fusing unit to perform the fusing operation, a temperature of a surface of the fusing roller should reach a predetermined value. Regarding the conventional image forming apparatus, power is sometimes supplied to the heating resistance member in the standby mode so that the surface temperature of the fusing roller can be maintained at a certain temperature value in order to print the printing data as fast as possible. However, since the temperature of the heating resistance member in the standby mode is low, much over-current flows to the heating resistance member and the filter cannot perform properly when the power is supplied to the heating resistance member in the standby mode of the image forming apparatus. Accordingly, it is difficult to control noise, particularly when power starts to be supplied to the fusing unit while the image forming apparatus is in the standby mode.

SUMMARY

The present general inventive concept provides an image forming apparatus capable of removing noise stably in a standby mode by suppressing noise from a wide variety of frequencies when the image forming apparatus is in the standby mode, and a method thereof.

Additional features and utilities of the present general inventive concept will be set forth in part in the description which follows and, in part, will be obvious from the description, or may be learned by practice of the general inventive concept.

Embodiments of the present general inventive concept can be achieved by providing an image forming apparatus, including a fusing unit to generate heat when supplied with a first power, at least one load to receive a second power, and a power supply unit to supply the second power to the at least one load at a continuously changing operating frequency when the first power is supplied to the fusing unit and the image forming apparatus is in a standby mode.

The power supply unit may supply the second power to a different load during at least time section after the first power is supplied to the fusing unit.

The operating frequency may be in a transition state during the at least one time section.

The image forming apparatus may further include a filter to transmit the first power to the fusing unit, wherein the fusing unit receives the first power that passes through the filter, and the power supply unit supplies the second power to the at least one load for a period of time when the filter is saturated.

The at least one load may include a load that operates when the image forming apparatus is in a printing mode.

The at least one load to which the second power is supplied by the power supply unit may determine the operating frequency.

The at least one load may include an exposure unit, a developing unit, and a transfer unit.

Embodiments of the present general inventive concept can also be achieved by providing a method of controlling an image forming apparatus including a fusing unit which generates heat in response to a first power and at least one load which receives a second power, the method including supplying the first power to the fusing unit when the image forming apparatus is in a standby mode, and supplying the second power to the at least one load at a continuously changing operating frequency.

The supplying of the second power may include supplying the second power to a different load of the at least one load during at least one time section.

The method may further include generating heat with the fusing unit in response to the first power that passes through a filter of the image forming apparatus, wherein the supplying of the second power may include supplying the second power to the at least one load for a period of time during which the filter is saturated.

The method may further include determining the operating frequency according to the at least one load to which the second power is supplied by the power supply unit.

Embodiments of the present general inventive concept can also be achieved by providing a computer-readable recording medium to contain computer-readable codes providing commands for computers to execute a process to control an image forming apparatus including a fusing unit which generates heat in response to a first power and at least one load which receives a second power, the process including supplying the first power to the fusing unit of the image forming apparatus that is in a standby mode, and supplying the second power to the at least one load at a continuously changing operating frequency.

Embodiments of the present general inventive concept can also be achieved by providing an image forming apparatus including, a fusing unit to receive a first power, and a plurality of loads to receive a second power when the fusing unit receives the first power, the second power alternating among the plurality of loads.

The second power may be supplied to the plurality of loads for one of at least one time section.

Embodiments of the present general inventive concept can also be achieved by providing a method of controlling an image forming apparatus, including supplying a first power to a fusing unit, and supplying a second power to alternate among a plurality of loads when the fusing unit receives the first power.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE EMBODIMENTS

Figure 1:
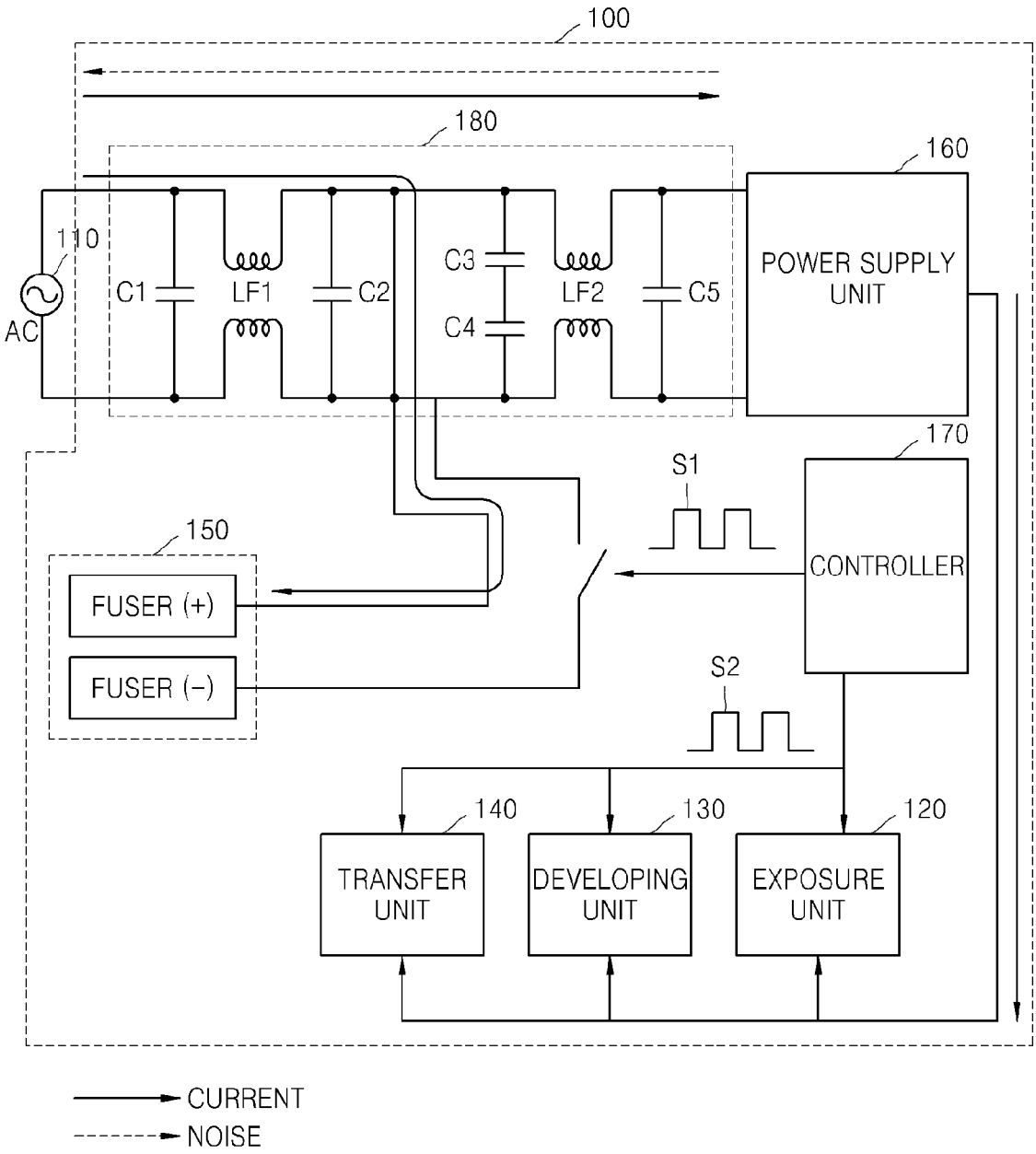
FIG. 1 is a block diagram of an image forming apparatus according to embodiments of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

An image forming apparatus and a method of controlling the image forming apparatus will be described with reference to accompanying drawings as follows.

FIG. 1 is a block diagram illustrating an image forming apparatus 100 according to an exemplary embodiment of the present general inventive concept. FIG. 1 illustrates the image forming apparatus 100 and an external power source 110.

The image forming apparatus 100 may be a printer or a multi-function peripheral (MFP) device having a printing function.

The external electric power source 110 is an alternating power source placed outside the image forming apparatus 100, and may be an electric power source connected to a wall outlet and generating 220V. According to exemplary embodiments of the present general inventive concept, a first electric power is supplied to a fusing unit 150 from, for example, the external power 110. The image forming apparatus 100 includes an exposure unit 120, a developing unit 130, a transfer unit 140, a fusing unit 150, an electric power supplying unit 160, a controller 170, and a filter 180.

The exposure unit 120 performs an exposure operation with respect to a photosensitive drum of the image forming apparatus 100 according to printing data that is to be printed so as to form an electrostatic latent image on the photosensitive drum.

The developing unit 130 develops the electrostatic latent image formed on the surface of the photosensitive drum using a developer, for example, toner, to form a developed image.

The transfer unit 140 transfers the developed image onto a printing medium.

The exposure unit 120, the developing unit 130, and the transfer unit 140 are examples of loads of the image forming apparatus 100. As referred to herein, the term "load" refers to not only a passive device having a resistance component, but may also denote any unit that operates in the image forming apparatus 100. In other words, the load may denote one or more units included in the image forming apparatus 100. For example, the exposure unit 120, the developing unit 130, and the transfer unit 140 may be loads that operate when the image forming apparatus 100 is in a printing mode (for example, the above units operate for a predetermined time period when the image forming apparatus 100 is in the printing mode), and do not operate when the image forming apparatus 100 is in the standby mode. For clarity, the fusing unit 150 is separately described from the one or more loads described throughout.

The fusing unit 150 fuses the image transferred on the printing medium by heating the printing medium. The fusing unit 150 is a fusing roller including a heating resistance member that generates heat in response to the first power received from the external power source 110 of the image forming apparatus 100. A surface temperature of the fusing roller may be increased to a predetermined temperature to perform the fusing operation.

The power supply unit 160 supplies electric power to at least one load in the image forming apparatus 100 (for example, the exposure unit 120, the developing unit 130, and the transfer unit 140). In more detail, the power supply unit 160 is a switch mode power supply (SMPS) that converts the first power supplied by the external power 110, that is, alternating current (AC) power, to direct current (DC) power of a predetermined voltage, and supplies the converted DC power to the loads at a predetermined operating frequency. In the present exemplary embodiments, the term "second power" refers to internal electric power that is supplied from the power supply unit 160 to the loads. In addition, the term "operating frequency" refers to the frequency of supplying the second power to the loads from the power supply unit 160. For example, when the power supply unit 160 supplies the second power to a load at an operating frequency of A Hz (where A is a real number), the power supply unit 160 supplies the second power to the load A times per second. The operating frequency of the power supply unit 160 may vary depending on the loads to which the second power is supplied by the power supply unit 160. Since the power supply unit 160 supplies the second power at least one load at a certain frequency after a switching operation is performed in the power supply unit 160, noise may occur and may be transmitted to the loads in the image forming apparatus 100 or may be discharged out of the image forming apparatus 100.

The controller 170 controls operations of the units included in the image forming apparatus 100, for example, the exposure unit 120, the developing unit 130, the transfer unit 140, the fusing unit 150, and the power supply unit 160. The controller 170 may be, for example, a central processing unit (CPU) in the image forming apparatus 100. Referring to FIG. 1, the controller 170 generates a control signal S1 to control the supply of the first power to the fusing unit 150, and a control signal S2 to control the supply of the second power to the loads 120, 130, and 140. The controller 170 is also a load that operates based on the second power supplied from the power supply unit 160 regardless of whether the image forming apparatus 100 is in the standby mode or the printing mode.

The filter 180 filters the noise in the image forming apparatus 100 to prevent the noise generated in the image forming apparatus 100 from being discharged out of the image forming apparatus 100. For example, the filter 180 may include capacitors C1, C2, C3, C4, and C5, and two line filters LF1 and LF2 as illustrated in FIG. 1. However, the filter 180 may include different components in various arrangements. The line filters LF1 and LF2 of FIG. 1 are formed of a coil that has an inductance component. A maximum current that may flow through the line filters LF1 and LF2, while keeping constant the inductance thereof, is referred to as a current coil rating. When a current exceeding the current coil rating flows through the line filter LF1 or LF2, the line filter LF1 or LF2 performs as a conductor without an inductance component, and thus reduces the operation of and/or prevents the filter 180 from operating properly. In the present exemplary embodiment, when the filter 180 is saturated, the current flowing through the line filter LF1 or LF2 is greater than the current coil rating, and the filter 180 operates abnormally.

Figure 2:
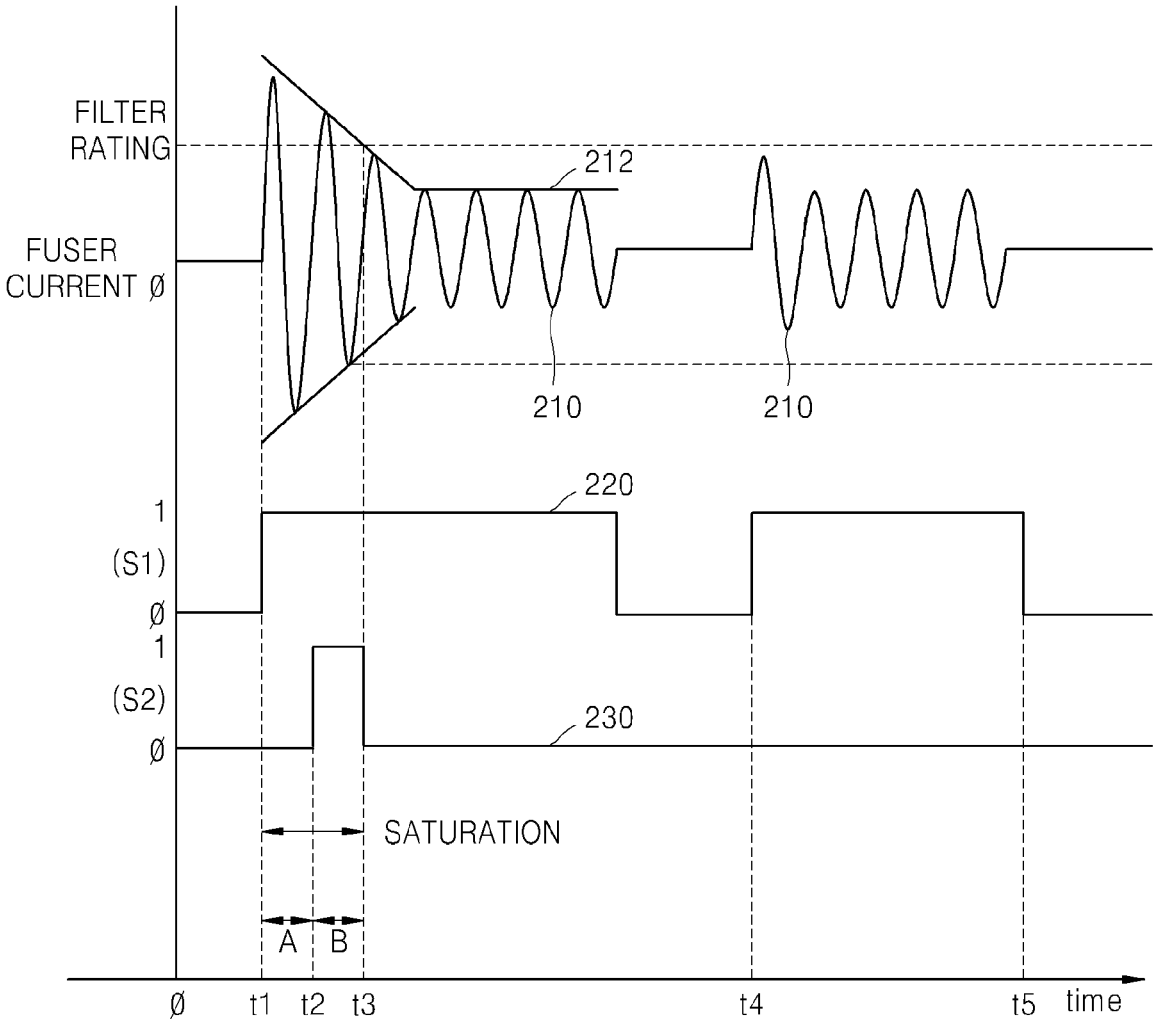
FIG. 2 is a waveform diagram to illustrate a method of controlling the image forming apparatus of FIG. 1 according to an embodiment of the present general inventive concept.

FIG. 2 is a waveform diagram to illustrate a method of controlling the image forming apparatus 100 of FIG. 1. Referring to FIG. 2, t1, t2, t3, t4, and t5 are natural numbers satisfying the inequality $0<t1<t2<t3<t4<t5$. The amount of time existing between t1, t2, t3, t4, and t5 are each referred to as a "time section." In other words, the time between t1 and t2, or the time between t4 and t5, are time sections. For example, the image forming apparatus 100 may be in the standby mode when $0 \leqq t \leqq t4$, where "t" is the time, and the image forming apparatus 100 may be in the printing mode when $t4<t \leqq t5$. Time may be expressed, for example, in milliseconds or [ms], as well as any other unit of time. In this exemplary embodiment, when the control signal S1 (220) is 1 the first power is supplied to the heating resistance member of the fusing unit 150, and when the control signal S1 (220) is 0, the first power is not supplied to the heating resistance member of the fusing unit 150. Additionally, in this exemplary embodiment, when the control signal S2 (230) is 1, the second power is supplied to the at least one load, and when the control signal S2 (230) is 0, the second power is not supplied to the at least one load in the image forming apparatus 100. In FIG. 2, "filter rating" denotes the current coil rating of the line filter LF1, and "fuser current" is the level of the current flowing through the heating resistance member of the fusing unit 150. In addition, reference numeral 212 denotes an envelope of the current waveform of an electric current 210 flowing through the heating resistance member of the fusing unit 150.

As described above, when the image forming apparatus 100 is in the printing mode, the fusing unit 150 performs the fusing operation by maintaining the surface temperature of the fusing roller of which the heating resistance member receives the first power at a predetermined temperature, for example, 180° C. On the other hand, even when the image forming apparatus 100 is in the standby mode, the fusing unit 150 supplies the second power to the heating resistance member occasionally so that the surface temperature of the fusing roller can be maintained at a predetermined level. Therefore, when the image forming apparatus 100 enters the printing mode, the surface temperature of the fusing roller may reach the predetermined temperature rapidly, and thus, the image forming apparatus 100 can perform the printing operation rapidly. Here, the predetermined level of the surface temperature may be much lower than the predetermined temperature.

Since the temperature of the heating resistance member is very low and the heating resistance of the fusing unit 150 is in proportion to the temperature of the heating resistance member, much over-current flows through the heating resistance member when the first power starts to be supplied to the heating resistance member in the image forming apparatus when it is in the standby mode. Until the resistance value rises to a predetermined level due to the temperature rising of the heating resistance member, the current exceeding the current coil rating of the heating resistance member flows through the heating resistance member. In other words, when the heating resistance member in the image forming apparatus 100 that is in the standby mode starts receiving the first power, the filter 180 (for example, the line filter LF1 of FIG. 1) is saturated for a predetermined time period. That is, referring to FIG. 2, the first power is supplied to the heating resistance member of the fusing unit 150 at a point $t=t1$ [ms], and the over-current flows through the heating resistance when $t1 \leqq t \leqq t3$. Therefore, the current (electric current 210) flowing through the heating resistance member exceeds the current coil rating (filter rating) of the filter 180 (for example, the line filter LF1), and the filter 180 is saturated. When the filter 180 is saturated, the noise generated by the image forming apparatus 100 is discharged.

According to the image forming apparatus 100 and the method of controlling the image forming apparatus 100 of the present exemplary embodiments, even when the image forming apparatus 100 is in the standby mode, the power supply unit 160 may generate noise of different magnitudes in various frequency bands.

Since the image forming apparatus 100 does not perform a printing operation in the standby mode, the at least one load, for example, the exposure unit 120, the developing unit 130, and the transfer unit 140 in the image forming apparatus 100, do not need to operate. Accordingly, the second power may not be supplied to the at least one load in the image forming apparatus 100 when it is in the standby mode. However, according to the image forming apparatus 100 and the method of controlling the image forming apparatus 100 of the present exemplary embodiment, when the first power starts to be supplied to the fusing unit 150 of the image forming apparatus 100 in the standby mode, the power supply unit 160 of the image forming apparatus 100 in the standby mode supplies the second power to each of the loads during each time section for at least one time section after the supply of the first power has been started. Therefore, the second power is supplied to the at least one load at a continuously changing operating frequency for at least one time section. For example, when the image forming apparatus 100 is in the standby mode, although the at least one load (for example, the exposure unit 120, the developing unit 130, and the transfer unit 140) does not operate, the power supply unit 160 supplies the second power to the at least one load during the predetermined time section (for example, in FIG. 2, section B when $t2 \leqq t \leqq t3$) in a time period (for example, in FIG. 2, the time period when $t1 \leqq t \leqq t3$), in which the filter 180 is saturated due to the over-current flowing through the heating resistance member. Time may be expressed, for example, in milliseconds or [ms], as well as any other unit of time. The saturation time may be calculated in advance and the at least one time section in the saturation time may be set in advance, and the image forming apparatus 100 may recognize the above saturation time and the time section.

For example, as illustrated in FIG. 2, in the time section A (t1≦t≦t2), the power supply unit 160 may supply the second power to the controller 170, however, in the time section B (t2≦t≦t3), the power supply unit 160 supplies the second power to the exposure unit 120, the developing unit 130, the transfer unit 140, and the controller 170. Therefore, the operating frequency (f_A) of the power supply unit 160 in a steady-state during the time section A is different from the operating frequency (f_B) of the power supply unit 160 in the steady-state during the time section B. On the other hand, the operating frequency f_A of the power supply unit 160 is not immediately changed on changing or determining the load to which the second power will be supplied from the power supply unit 160, but is changed to the operating frequency f_B through a transition state. In other words, the operating frequency of the power supply unit 160 is not exactly f_A at the point where t=t1. As time progresses from the point t=t1, the operating frequency of the power supply unit 160 reaches f_A. Likewise, the operating frequency of the power supply unit 160 is not exactly f_B at the point t=t2. As time elapses from the point of t=t2, the operating frequency of the power supply unit 160 reaches f_B. In other words, the operating frequency of the power supply unit 160 changes during the transition from operating frequency f_A to operating frequency f_B. The operating frequency continuously changes over time as the power supply unit 160 supplies the second power to different loads. A length of the time section A may be the time period before the operating frequency of the power supply unit 160 reaches f_A (that is, t2 is a point in time before the operating frequency of the power supply unit 160 enters the steady-state). In addition, a length of the time section B may be the time period before the operating frequency of the power supply unit 160 reaches f_B (that is, t3 is a point in time before the operating frequency of the power supply unit 160 enters the steady-state). Therefore, during the time period in which the image forming apparatus 100 is in the standby mode and the filter 180 is saturated (t1≦t≦t3), the power supply unit 160 does not generate biased noise that has a large magnitude at a certain frequency, for example, f_A, but instead generates noise having low magnitudes dispersed throughout multiple frequencies.

According to FIG. 2, when the power supply unit 160 supplies the second power in at least some of the time sections in which the filter 180 is saturated, the controller 170 divides the time period when the filter 180 is saturated into a plurality of time sections, and the power supply unit 160 supplies the second power to a different load in each of the plurality of time sections. For example, the controller 180 may divide the time period when the filter 180 is saturated in the standby mode into time section C (not illustrated), time section D (not illustrated), and time section E (not illustrated) (E, D, and C in timing order), and the power supply unit 160 supplies the second power to the exposure unit 120 in the time section C, supplies the second power to the developing unit 130 in the time section D, and supplies the second power to the transfer unit 140 in the time section E.

Accordingly, even when the image forming apparatus 100 is in the standby mode and the filter 180 is saturated so that the noise generated in the image forming apparatus 100 are discharged out of the image forming apparatus 100, the noise generated in the image forming apparatus 100 in the standby mode is dispersed to multiples frequencies evenly, and is not biased to a certain frequency. As described above, according to the exemplary embodiments of the present general inventive concept, the noise generated in the image forming apparatus 100 in the standby mode can be stably controlled. Therefore, noise can be discharged in a manner that reduces or prevents problems related to noise.

Figure 3:
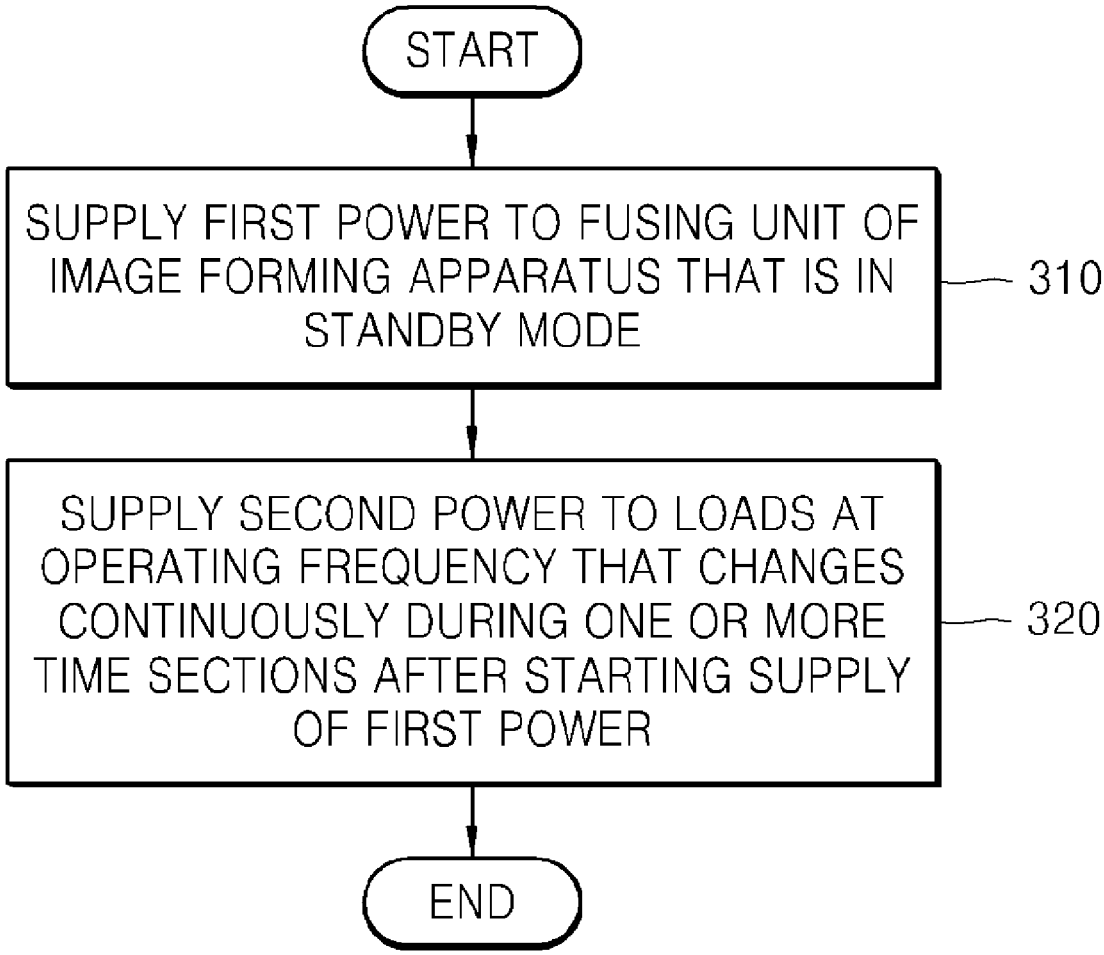
FIG. 3 is a flowchart illustrating a method of controlling the image forming apparatus of FIG. 1 according to embodiments of the present general inventive concept.

FIG. 3 is a flowchart illustrating a method of controlling the image forming apparatus 100 according to an exemplary embodiment of the present general inventive concept. According to the present exemplary embodiment, noise is dispersed to multiple frequencies when the image forming apparatus 100 is in the standby mode, and thus, the noise is stably controlled when the image forming apparatus 100 is in the standby mode through operations 310 and 320.

The controller 170 controls the image forming apparatus 100 so that the external power supply 110 can supply the first power to the fusing unit 150 when the image forming apparatus 100 is in the standby mode (operation S310).

In addition, when the first power starts to be supplied to the fusing unit 150 according to the result of operation S310, the power supply unit 160 of the image forming apparatus 100 supplies the second power to different loads in each of the at least one time section when starting the supply of the first power, so that the second power can be supplied to the loads at a continuously changing operating frequency during at least one time section (operation S320).

The present general inventive concept can also be embodied as computer-readable codes on a computer-readable medium. The computer-readable medium can include a computer-readable recording medium and a computer-readable transmission medium. The computer-readable recording medium is any data storage device that can store data as a program which can be thereafter read by a computer system. Examples of the computer-readable recording medium include read-only memory (ROM), random-access memory (RAM), CD-ROMs, DVDs, Blu-Ray discs, magnetic tapes, floppy disks, optical data storage devices, and the like. The computer-readable recording medium can also be distributed over network coupled computer systems so that the computer-readable code is stored and executed in a distributed fashion. Also, functional programs, codes, and code segments to accomplish the present general inventive concept can be easily construed by programmers skilled in the art to which the present general inventive concept pertains.

The present general inventive concept may be modified variously within the scope of thereof by one of ordinary skill in the art. For example, the contents related to the standby mode in the specification can be applied to a sleep mode that is an operating mode of the image forming apparatus 100 for reducing power consumption in a case where the standby mode continues for a predetermined time or longer. In addition, contents relating to the printing mode in the specification can be applied to a warm-up mode that is an operating mode of the image forming apparatus 100 right after turning the image forming apparatus 100 on. The exemplary embodiments have been explained for illustration purposes, and should be considered in the descriptive sense and not for purposes of limitation. Therefore, the scope of the present inventive concept is defined not by the detailed description but by the appended claims, and all differences within the scope will be construed as being included in the present general inventive concept.

According to the image forming apparatus 100 and the method of controlling the same of the present general inventive concept, when the first power starts to be supplied to the heating resistance member of the fusing unit 150 when the image forming apparatus 100 is in the standby mode, the SMPS supplies the second power to the at least one load (for example, the exposure unit 120, the developing unit 130, and the transfer unit 140) that start to operate when the image forming apparatus 100 is in the printing mode. During at least one time section after supplying the first power to the fusing unit 150, the power supply unit 160 supplies the second power to the loads that operate in every time section. Therefore, the image forming apparatus 100 of the exemplary embodiments of the present general inventive concept may supply the second power to the loads at a continuously changing operating frequency for at least one time section when the first power is supplied to the fusing unit 150 when the image forming apparatus 100 is in the standby mode. Accordingly, when the image forming apparatus 100 is in the standby mode, the noise generated by the power supplying unit 160 is not biased to a certain frequency (that is, noise having a large magnitude at a certain frequency), but noise that is dispersed evenly throughout multiple frequencies (that is, noise having small magnitude in multiple frequency bands). Consequently, according to the present general inventive concept, even when the noise in the image forming apparatus 100 is discharged out of the image forming apparatus 100 because the filter 180 is saturated while the image forming apparatus 100 is in the standby mode, the noise is in a tolerable range. Therefore, the noise generated in the image forming apparatus 100 can be stably controlled.

Although several embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus comprising:

a fusing unit to generate heat when supplied with a first power;

at least one load to receive a second power; and a power supply unit to supply the second power to the at least one load at a continuously changing operating frequency when the first power is supplied to the fusing unit and the image forming apparatus is in a standby mode.

2. The image forming apparatus of claim 1, wherein during at least one time section after the first power is supplied to the fusing unit, the power supply unit supplies the second power to a different load during the at least one time section.

3. The image forming apparatus of claim 2, wherein the operating frequency is in a transition state during the at least one time section.

4. The image forming apparatus of claim 1, further comprising:

a filter to transmit the first power to the fusing unit, wherein the fusing unit receives the first power that passes through the filter, and the power supply unit supplies the second power to the at least one load for a period of time when the filter is saturated.

5. The image forming apparatus of claim 1, wherein the at least one load includes a load that operates when the image forming apparatus is in a printing mode.

6. The image forming apparatus of claim 1, wherein the at least one load to which the second power is supplied by the power supply unit determines the operating frequency.

7. The image forming apparatus of claim 1, wherein the at least one load includes an exposure unit, a developing unit, and a transfer unit.

8. A method of controlling an image forming apparatus including a fusing unit which generates heat in response to a first power and at least one load which receives a second power, the method comprising:

supplying the first power to the fusing unit when the image forming apparatus is in a standby mode; and supplying the second power to the at least one load at a continuously changing operating frequency.

9. The method of claim 8, wherein the supplying of the second power comprises:

supplying the second power to a different load of the at least one load during at least one time section.

10. The method of claim 9, wherein the operating frequency is in a transition state during the at least one time section.

11. The method of claim 8, further comprising:

generating heat with the fusing unit in response to the first power that passes through a filter of the image forming apparatus, wherein the supplying of the second power comprises supplying the second power to the at least one load for a period of time during which the filter is saturated.

12. The method of claim 8, wherein the at least one load includes a load that operates when the image forming apparatus is in a printing mode.

13. The method of claim 8, further comprising:

determining the operating frequency according to the at least one load to which the second power is supplied.

14. The method of claim 8, wherein the at least one load includes an exposure unit, a developing unit, and a transfer unit.

15. A computer-readable recording medium to contain computer-readable codes providing commands for computers to execute a process to control an image forming apparatus including a fusing unit which generates heat in response to a first power and at least one load which receives a second power, the process comprising:

supplying the first power to the fusing unit of the image forming apparatus that is in a standby mode; and supplying the second power to the at least one load at a continuously changing operating frequency.

16. An image forming apparatus, comprising:

a fusing unit to receive a first power; and a plurality of loads to receive a second power when the fusing unit receives the first power, the second power alternating among the plurality of loads.

17. The image forming apparatus of claim 16, wherein the second power is supplied the plurality of loads for one of at least one time section.

18. A method of controlling an image forming apparatus, comprising:

supplying a first power to a fusing unit; and supplying a second power to alternate among a plurality of loads when the fusing unit receives the first power.

19. An image forming apparatus including a fusing unit to receive a first power from a first power supply, comprising:

a noise filter to filter electrical noise in the image forming apparatus;

an operating frequency control module that determines a saturation time when the noise filter is saturated and that determines at least one time section during the saturation time; and a second power supply that outputs a second power to at least one load during the at least one time section within the saturation time in response to a load selection signal.

20. The image forming apparatus of claim 19, wherein the at least one time section includes a plurality of time sections each corresponding to a respective load and the second power is output to the respective load during each corresponding time section.

21. The image forming apparatus of claim 20, wherein the operating frequency control module detects each time section within the saturation time and outputs a load selection signal to output the second power to the respective load in response to detecting the corresponding time section.

22. A method of reducing electrical noise in an image forming apparatus including a fusing unit to receive a first power from a first power supply, comprising:

determining a saturation time when a noise filter filtering noise is saturated;

determining at least one time section during the saturation time; and outputting a second power to at least one load during the at least one time section within the saturation time in response to a load selection signal.

23. The image forming apparatus of claim 22, wherein the at least one time section includes a plurality of time sections each corresponding to a respective load.

24. The image forming apparatus of claim 23, further comprising outputting the second power to the respective load during each corresponding time section.

25. The image forming apparatus of claim 24, further comprising detecting each time section within the saturation time and outputting the second power to the respective load in response to detecting the corresponding time section.

* * * * *